US009102451B2

(12) United States Patent
McClung et al.

(10) Patent No.: US 9,102,451 B2
(45) Date of Patent: Aug. 11, 2015

(54) ROTATING TAB

(71) Applicant: STOLLE MACHINERY COMPANY, LLC, Centennial, CO (US)

(72) Inventors: James A. McClung, Canton, OH (US); Aaron E. Carstens, Centerville, OH (US); Jason A. Davidson, Sidney, OH (US); Gregory H. Butcher, Columbus, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 14/519,575

(22) Filed: Oct. 21, 2014

(65) Prior Publication Data

US 2015/0053681 A1 Feb. 26, 2015

Related U.S. Application Data

(62) Division of application No. 13/974,265, filed on Aug. 23, 2013, now Pat. No. 8,893,913.

(51) Int. Cl.
*B65D 51/16* (2006.01)
*B65D 17/00* (2006.01)

(52) U.S. Cl.
CPC ..... *B65D 51/1677* (2013.01); *B65D 17/165* (2013.01); *B65D 2517/0092* (2013.01)

(58) Field of Classification Search
CPC .. B65D 17/161; B65D 17/163; B65D 17/165; B65D 51/1677; B65D 51/1672; B65D 51/16; B32D 51/383; B32D 51/38
USPC ..... 220/271, 272, 270, 268, 269, 266, 265, 220/260, 906; 413/17, 16, 15, 14, 12, 8; 53/492
See application file for complete search history.

(56) References Cited

U.S. PATENT DOCUMENTS

| | | | | |
|---|---|---|---|---|
| 5,456,378 | A * | 10/1995 | DeMars | 220/269 |
| 2008/0011786 | A1* | 1/2008 | Mathabel et al. | 222/541.9 |
| 2011/0266281 | A1* | 11/2011 | Thiemann et al. | 220/271 |
| 2012/0031056 | A1* | 2/2012 | Chasteen et al. | 53/492 |

* cited by examiner

*Primary Examiner* — Robert J Hicks
(74) *Attorney, Agent, or Firm* — Eckert Seamans Cherin & Mellott, LLC; Grant E. Coffield

(57) ABSTRACT

A rotating tab is provided. The tab includes a body having a first end and a second end disposed opposite and distal from the first end, a nose portion located at or about the first end of the tab, a lift portion located at or about the second end of the tab, and a rivet receiving portion disposed proximate the nose portion. The rivet receiving portion includes a rivet hole. A rivet extends through the rivet hole and is staked to fasten the rivet receiving portion of the tab to a can end. The body of the tab is structured to be rotated about the rivet to align a portion of the tab with a secondary scoreline in the can end. A portion of the tab is structured to be depressed to sever the secondary scoreline to vent the can end.

10 Claims, 17 Drawing Sheets

ROTATING TAB

CROSS-REFERENCE TO RELATED APPLICATION

This application is a divisional of U.S. patent application Ser. No. 13/974,265, filed on Aug. 23, 2013 and entitled, "ROTATING TAB."

BACKGROUND

1. Field

The disclosed concept relates generally to containers and, more particularly, to can ends for containers, such as beer and beverage cans. The disclosed concept also relates to a rotating tab and associated method for can ends.

2. Background Information

Metallic containers (e.g., cans) for holding products such as, for example, liquids, beverages, or food products, are typically provided with an easy open can end on which an opening mechanism, such as a pull tab, is attached (e.g., without limitation, riveted) to a tear strip or severable panel. Typically, the tear strip is defined by a scoreline in the exterior surface (e.g., public side) of the can end. The pull tab, commonly referred to simply as the "tab," is structured to be lifted, pulled, and/or rotated to sever the scoreline and deflect the tear strip, thereby creating an opening for dispensing the contents of the can.

When the can end is made, it originates as a can end shell, which is formed from a sheet metal product (e.g., without limitation, sheet aluminum; sheet steel). The shell is then conveyed to a conversion press, which has a number of successive tool stations. As the shell advances from one tool station to the next, conversion operations such as, for example and without limitation, rivet forming, paneling, scoring, embossing, tab securing and tab staking, are performed until the shell is fully converted into the desired can end and is discharged from the press. Typically, each tool station of the conversion press includes an upper tool member, which is structured to be advanced towards a lower tool member upon actuation of a press ram. The shell is received between the upper and lower tool members. Titus, as the upper tool member engages the shell, the upper and/or lower tool members respectively act upon the public and/or product (e.g., interior side, which faces the can body) sides of the shell, in order to perform a number of the aforementioned conversion operations. Upon completion of a given operation, the press ram retracts the upper tool member and the partially converted shell is moved to the next successive tool station, or the tooling is changed within the same station, to perform the next conversion operation.

In the canmaking industry, there is an ongoing desire to improve the rate and manner in which the contents of the container are dispensed. With respect to beverage cans, the can end design can significantly impact the pour characteristics of the can. The opening of a conventional large open end (LOE), for example, is generally not large enough to allow sufficient air to displace the liquid volume, and subsequent vacuum, as the liquid is poured from the container. That is, as the liquid leaves the container, air is entrained through the primary pour opening causing a pressure differential between the interior and exterior of the can, thereby forming the aforementioned vacuum, behind the liquid. This, in turn, creates fluid turbulence and interrupted or discontinuous flow. As a result, "glugging" and/or splashing, a slower than desired pour or flow rate, and/or excessive carbonation or foaming of the dispensed liquid, can occur.

Prior proposals for addressing these issues employ a secondary aperture behind the primary pour opening, that is pierced to create a vent. However, such can ends require an additional, separate tool (e.g., without limitation, church key; bottle opener; screw driver) or object (e.g., without limitation, key) in order to sever the secondary aperture and suitably vent the container.

There is, therefore, room for improvement in can ends for containers, such as beer and beverage cans, and in tabs and associated methods therefor.

SUMMARY

These needs and others are met by embodiments of the disclosed concepts, which are directed to a rotating tab for containers, such as beer and beverage cans, and associated methods.

As one aspect of the disclosed concept, a tab is provided for a can end. The can end includes an end panel, a rivet extending outwardly from the end panel, a primary scoreline defining a ear panel in the end panel for providing a primary pour opening in the can end, and a secondary scoreline in the end panel. The tab comprises: a body including a first end and a second end disposed opposite and distal from the first end; a nose portion located at or about the first end of the tab; a lift portion located at or about the second end of the tab; and a rivet receiving portion disposed proximate the nose portion, the rivet receiving portion including a rivet hole, the rivet extending through the rivet hole and being staked to fasten the rivet receiving portion of the tab to the can end. The body of the tab is structured to be rotated about the rivet to align a portion of the tab with the secondary scoreline. A portion of the tab is structured to be depressed to sever the secondary scoreline to vent the can end.

The lift portion of the tab may have an arcuate edge profile, and the secondary scoreline may have a profile substantially similar to the arcuate edge profile of the lift portion.

The lift portion may include a protrusion, wherein the protrusion is structured to extend outwardly from the tab toward the end panel. The lift portion may include a button mechanism.

The end panel of the can end may further include a pocket, and a portion of the lift portion of the tab may be structured to be rotated into the pocket to align a feature of the lift portion with respect to the secondary scoreline.

A can end employing the aforementioned tab, and an associate method of venting a can using such tab, are also disclosed.

BRIEF DESCRIPTION OF THE DRAWINGS

A full understanding of the disclosed concept can be gained from the following description of the preferred embodiments when read in conjunction with the accompanying drawings in which:

FIG. 6 is a top plan view of the can end and rotating tab therefor of

FIG. 5, showing the tab in a rotated position;

DESCRIPTION OF THE PREFERRED EMBODIMENTS

Figure 1:
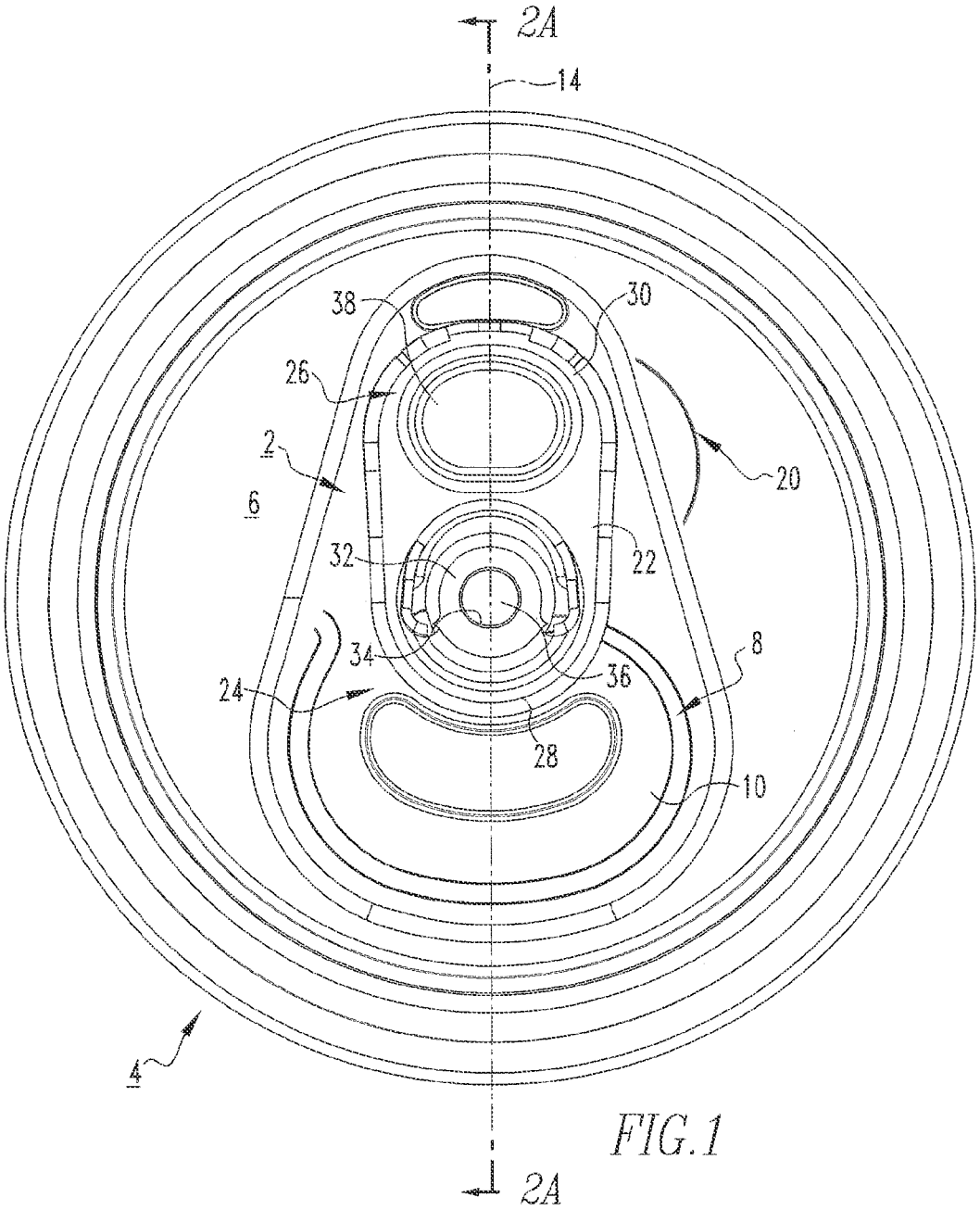
FIG. 1 is a top plan view of a can end and rotating tab therefor, in accordance with an embodiment of the disclosed concept, showing the tab in the standard position.

For purposes of illustration, embodiments of the disclosed concept will be described as applied to can ends for beverage/beer cans, although it will become apparent that they could also be employed to other contains such as, for example and without limitation, cans for liquids other than beer and beverages, and food cans.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As employed herein, the terms "can" and "container" are used substantially interchangeably to refer to any known or suitable container, which is structured to contain a substance (e.g., without limitation, liquid; food; any other suitable substance), and expressly includes, but is not limited to, food cans, as well as beverage cans, such as beer and soda cans.

As employed herein, the term "can end" refers to the lid or closure that is structured to be coupled to a can, in order to seal the can.

As employed herein, the term "can end shell" is used substantially interchangeably with the term "can end." The "can end shell" or simply the "shell" is the member that is acted upon and is converted by the disclosed tooling to provide the desired can end.

As employed herein, the term "standard position" shall refer to the position of the tab on a can end before any movement or actuation of the tab occurs to open and/or vent the can end.

As employed herein, the term "rotated position" shall refer to a position wherein the tab has been rotated (e.g., moved or pivoted clockwise or counterclockwise) from the standard position to a different, non-standard position.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
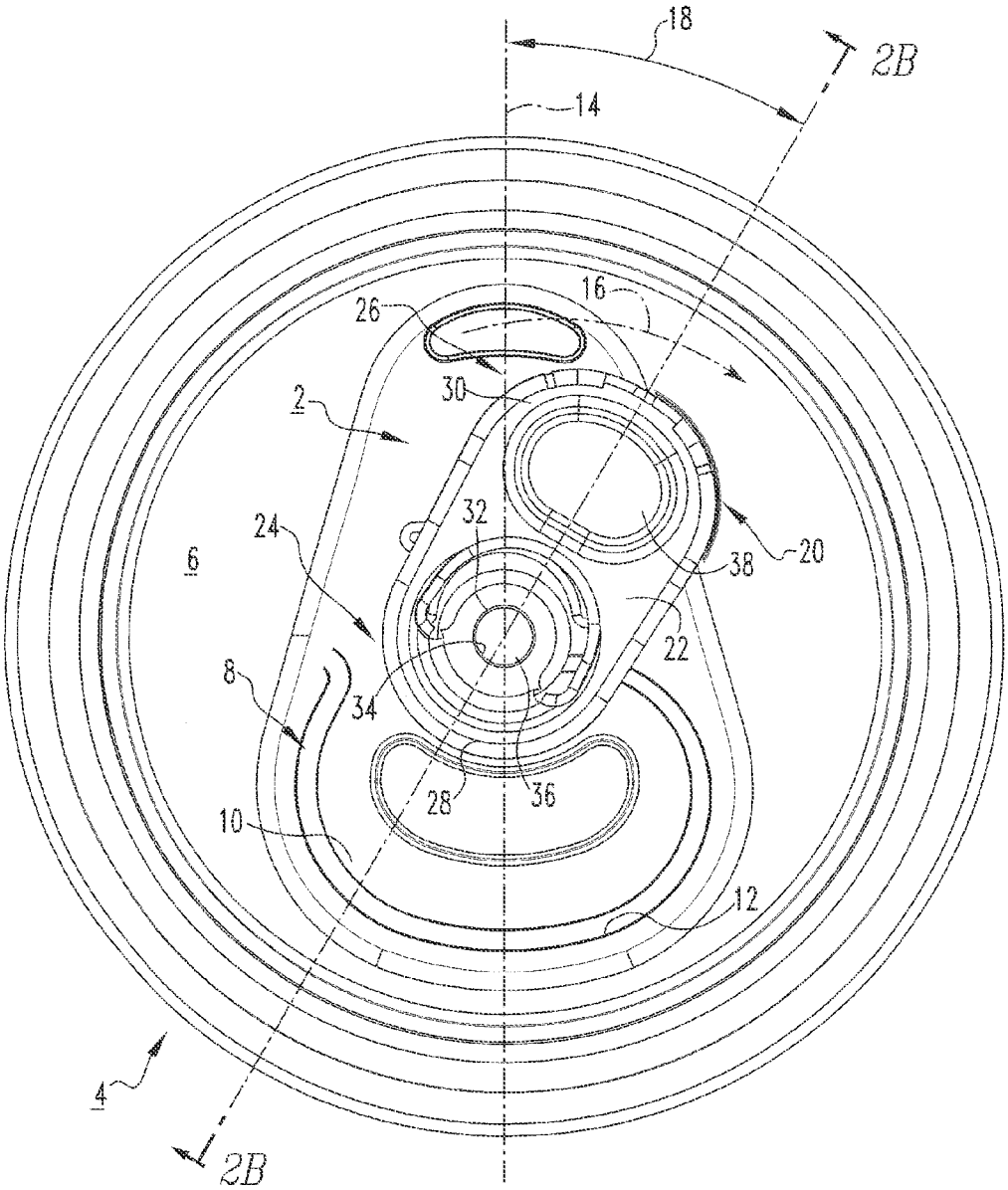
FIG. 2 is a top plan view of the can end and rotating tab therefor of FIG. 1, showing the tab in a rotated position.
Figure 2A:
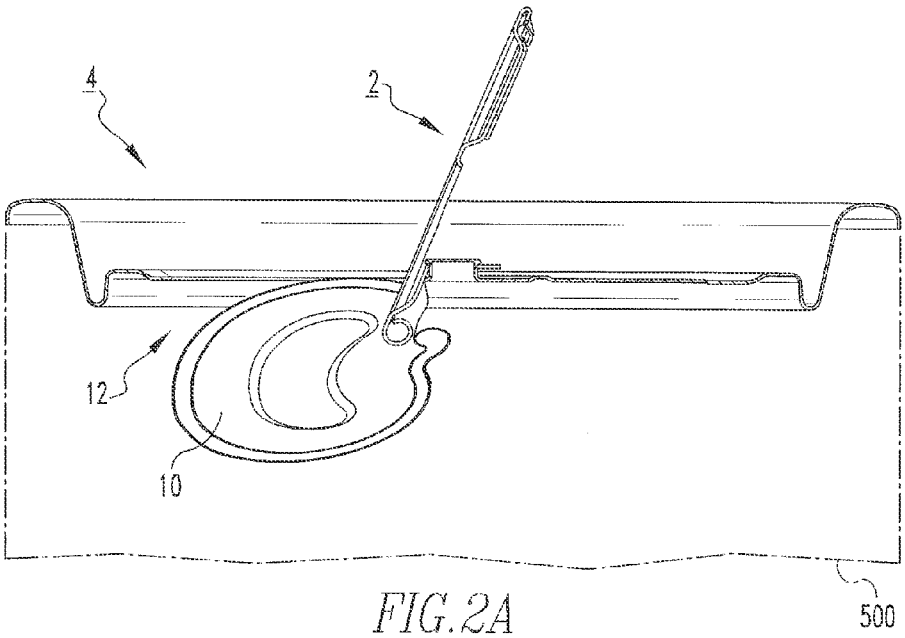
FIG. 2A is a section view taken along line 2A-2A of FIG. 1.

FIGS. 1 and 2 show a tab 2 for a can end 4, in accordance with one non-limiting embodiment of the disclosed concept. Among other features, the can end 4 includes an end panel 6 and a primary scoreline 8, which defines a tear panel 10. Accordingly, when the tab 2 is actuated (e.g., without limitation, lifted and pivoted, as shown in FIG. 2A) it will sever the primary scoreline 8 about the tear panel 10, and depress the tear panel 10 downward (see, for example, FIG. 2A), thereby providing a primary pour opening 12 (partially shown in FIGS. 2A and 2B) in the can end 4 for dispensing the contents of the container or can 500 (partially shown in simplified form in phantom line drawing in FIG. 2A) to which the can end 4 is affixed.

The tab 2 is shown in the standard position in FIG. 1. In FIG. 2 the tab 2 has been rotated, in accordance with an aspect of the disclosed concept. That is, in FIG. 1, the tab 2 has not been rotated with respect to the longitudinal axis 14, shown. In FIG. 2, the tab 2 has been rotated (e.g., clockwise in the direction of arrow 16 from the perspective of FIG. 2) at an angle 18 with respect to the longitudinal axis 14, as shown.

Continuing to refer to FIGS. 1 and 2, the example can end 4 further includes a secondary scoreline 20, which is structured to be severed to vent the can end 4.

The example tab 2, includes a body 22 having opposing first and second ends 24, 26. A nose portion 28 is located at or about the first end 24 of the tab 2, and a lift portion 30 is located at or about the second end 26 of the tab 2. A rivet receiving portion 32 is disposed proximate the nose portion 24, and includes a rivet hole 34. A rivet 36 extends outwardly from the end panel 6, through the rivet hole 34, and is staked to fasten the rivet receiving portion 32 of the tab 2 to the can end 4.

In the non-limiting example of FIGS. 1 and 2, the body 22 of the tab 2 preferably further includes a recessed panel 38. Such a tab 2, which does not include a finger hole, is commonly referred to as a promotional tab 2. The recessed panel 38 can be used, for example and without limitation, to facilitate the user rotating (e.g., clockwise in the direction of arrow 16 in FIG. 2) the tab 2 about the rivet 36, from the standard position of FIG. 1, to the rotated position of FIG. 2. The recessed panel 38 also provides the user with a location to facilitate depressing the tab 2 and, in particular the lift portion 30, to sever the aforementioned secondary scoreline 20 and vent the can end 4 (best shown in the section views of FIGS. 29 and 2C). In other words, the tab 2 itself advantageously functions to sever the secondary scoreline 20 and vent the can end 4.

Figure 2B:
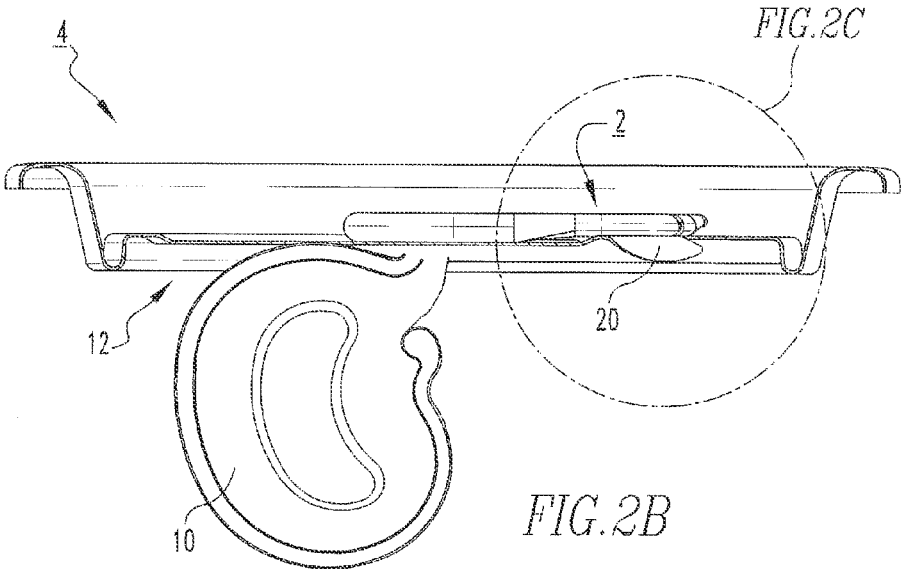
FIG. 2B is a section view taken along line 2B-29 of FIG. 2.

Therefore, unlike known vented can end designs, no separate tool or device (not shown) is required to vent the can end 4 at a location that is separate and distal from the primary scoreline 8 and pour opening 12 (FIGS. 2A and 2B). It will be appreciated that a standard tab (e.g., a tab with a conventional finger hole (not shown) rather than the recessed panel 38 of the example promotional tab 2), or any other known or suitable type and/or configuration of tab (not shown) could be employed, in accordance with the disclosed concept.

In the example of FIGS. 1 and 2, the secondary scoreline 20 has a profile that generally matches the radius or profile of the lift portion 30 of the tab 2, as shown. Thus, it will be appreciated that the secondary scoreline or vent score 20 is preferably disposed at a position on the can end 4 such that, when the tab 2 is rotated to the position shown in FIG. 2, a portion (e.g., without limitation, edge; bottom; feature) of the lift portion 30 can be used to sever the secondary scoreline 20, for example, by being depressed downward (see, for example, the depressed portion shown in FIGS. 2B and 2C, after the secondary scoreline 20 has been severed and depressed downward to vent the can end 4).

In one non-limiting example, the angle 18 at which the tab 2 is rotated with respect to longitudinal axis 14 is preferably between 20-60 degrees and, more preferably, is about 40 degrees. It will be appreciated that while the secondary scoreline or vent score 20, shown and described with respect to FIGS. 1 and 2, is an arcuate scoreline having a generally uniform radius of curvature that substantially matches the radius of curvature of the edge of the lift portion 30 of the tab 2, it could have any known or suitable alternative shape, location and/or configuration (not shown), without departing from the scope of the disclosed concept. It will further be appreciated that any known or suitable alternative type and/or configuration of tab (not shown), and/or any known or suitable portion or feature (e.g., without limitation, underside; edge; protrusion; extension; segment; member) of the tab 2, could be employed to depress and sever the secondary scoreline or vent score 20 to vent the can end 4, in accordance with the disclosed concept. For example and without limitation, the tab 2 could include a long leg, short leg geometry (not shown), wherein one side of the tab body 22 is longer than the other side, and wherein the longer side is disposed closer to the secondary scoreline or vent score 20, in order to further facilitate severing the scoreline 20 and venting the can end 4.

Figure 2C:
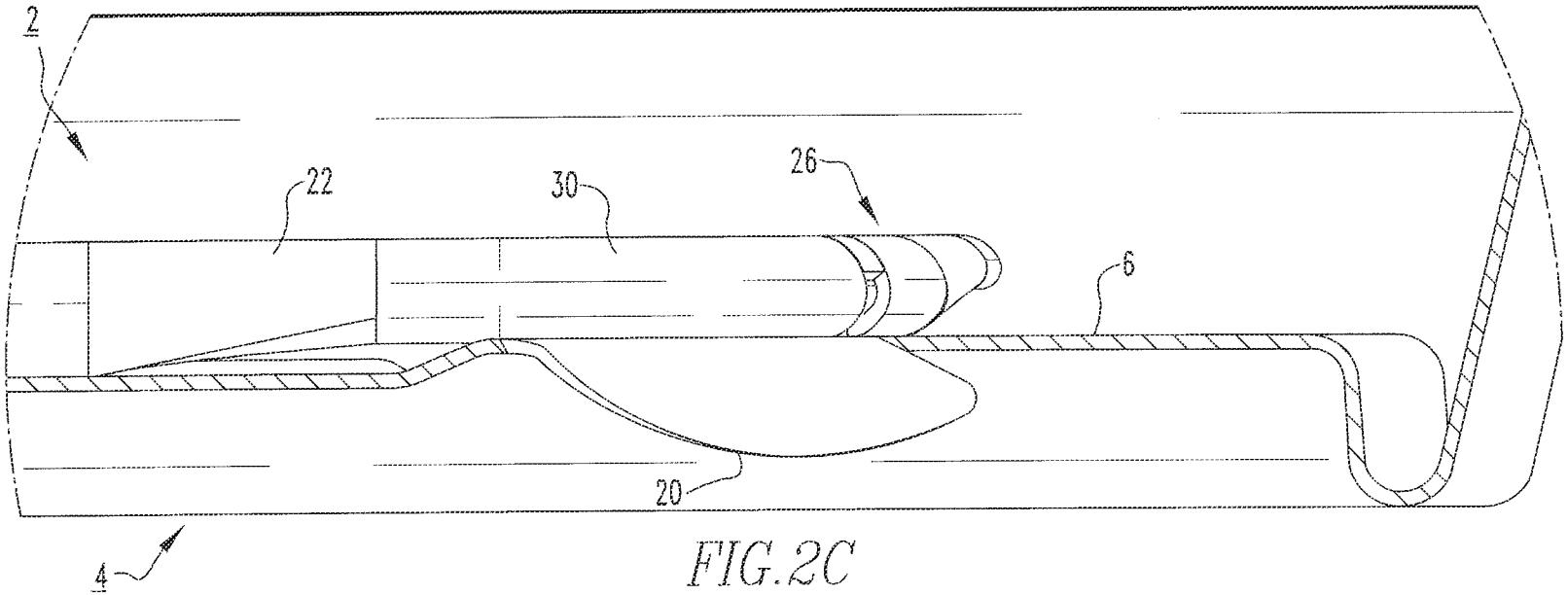
FIG. 2C is an enlarged view of section 2C of FIG. 2B.

Accordingly, a method of operating the rotating tab 2 to vent the can end 4 in accordance with a non-limiting aspect of the disclosed concept involves the following steps. First, the lift portion 30 is lifted (e.g., pivoted upwards from the perspective of FIGS. 1 and 2) to the position shown in FIG. 2A, causing the nose portion 28 of the tab 2 to sever the primary scoreline 8 and depress the tear panel 10 to open the primary pour opening 12, as shown. The lift portion 30 of the tab 2 is then pivoted e.g., pushed back downwards from the perspective of FIGS. 1 and 2) to the position shown in FIG. 2B, and the tab 2 is rotated (e.g., clockwise in the direction of arrow 16 of FIG. 2) to the rotated position shown in FIG. 2. Next the tab 2 and, in particular the lift portion 30 and/or recessed panel 38, is/are depressed to sever the secondary scoreline 20 to vent the can end 4, as shown in FIGS. 2B and 2C.

In view of the foregoing, it will be appreciated that the vent created by severing the secondary scoreline or vent score 20 provides the necessary ventilation to regulate (e.g., without limitation, equalize) the air pressure between the interior of the container (see, for example and without limitation, can 500 partially shown in simplified form in phantom line drawing in FIG. 1) and the exterior of the container 500 (FIG. 1). Consequently, disadvantages (e.g., without limitation, turbulence; glugging; slow pour rate; intermittent pouring; splashing; excessive carbonation and foaming) of prior art designs are substantially addressed and overcome, and the pour characteristics of the can end 4 are improved.

Figure 3:
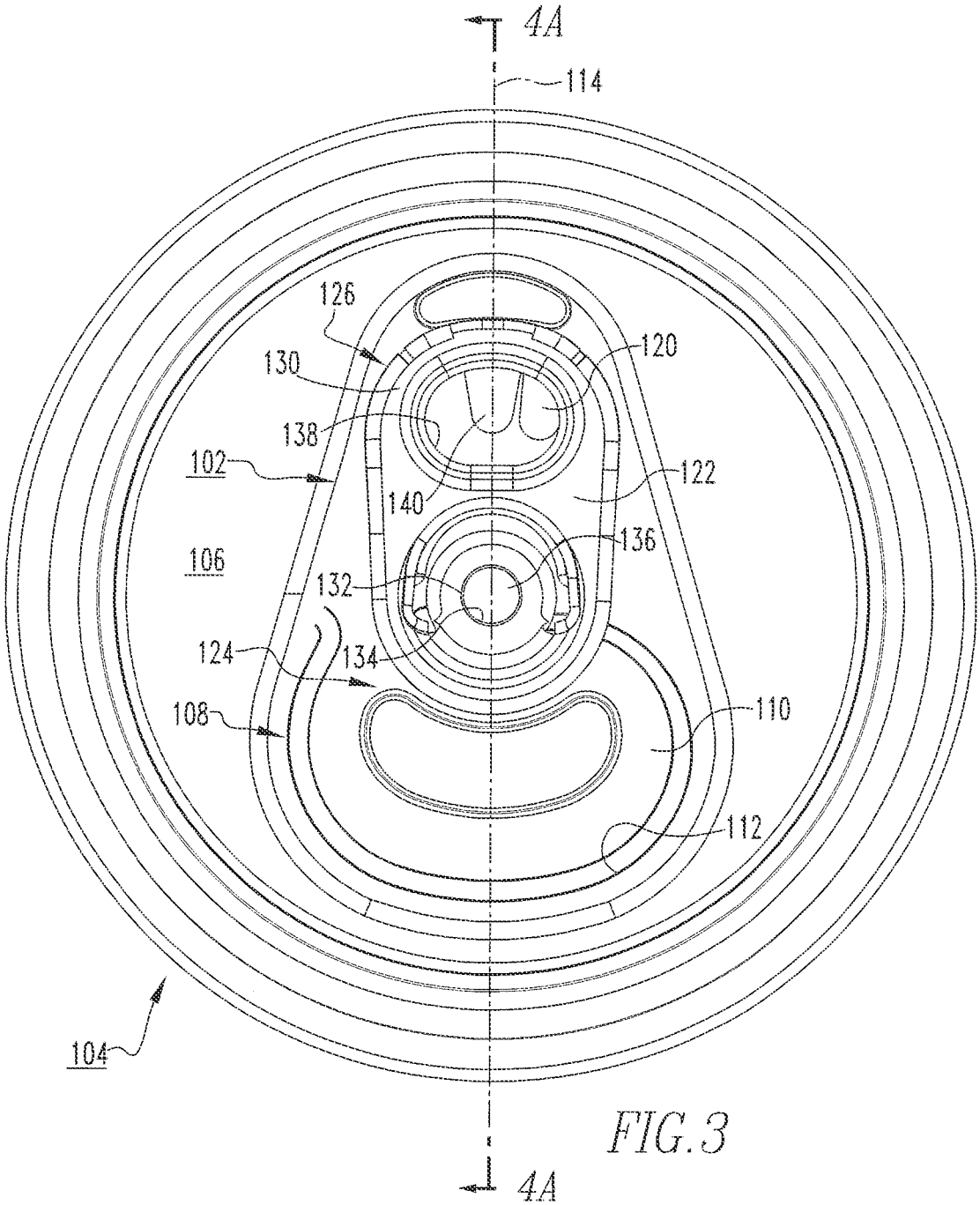
FIG. 3 is a top plan view of a can end and rotating tab therefor, in accordance with another embodiment of the disclosed concept, showing the tab in the standard position.
Figure 4:
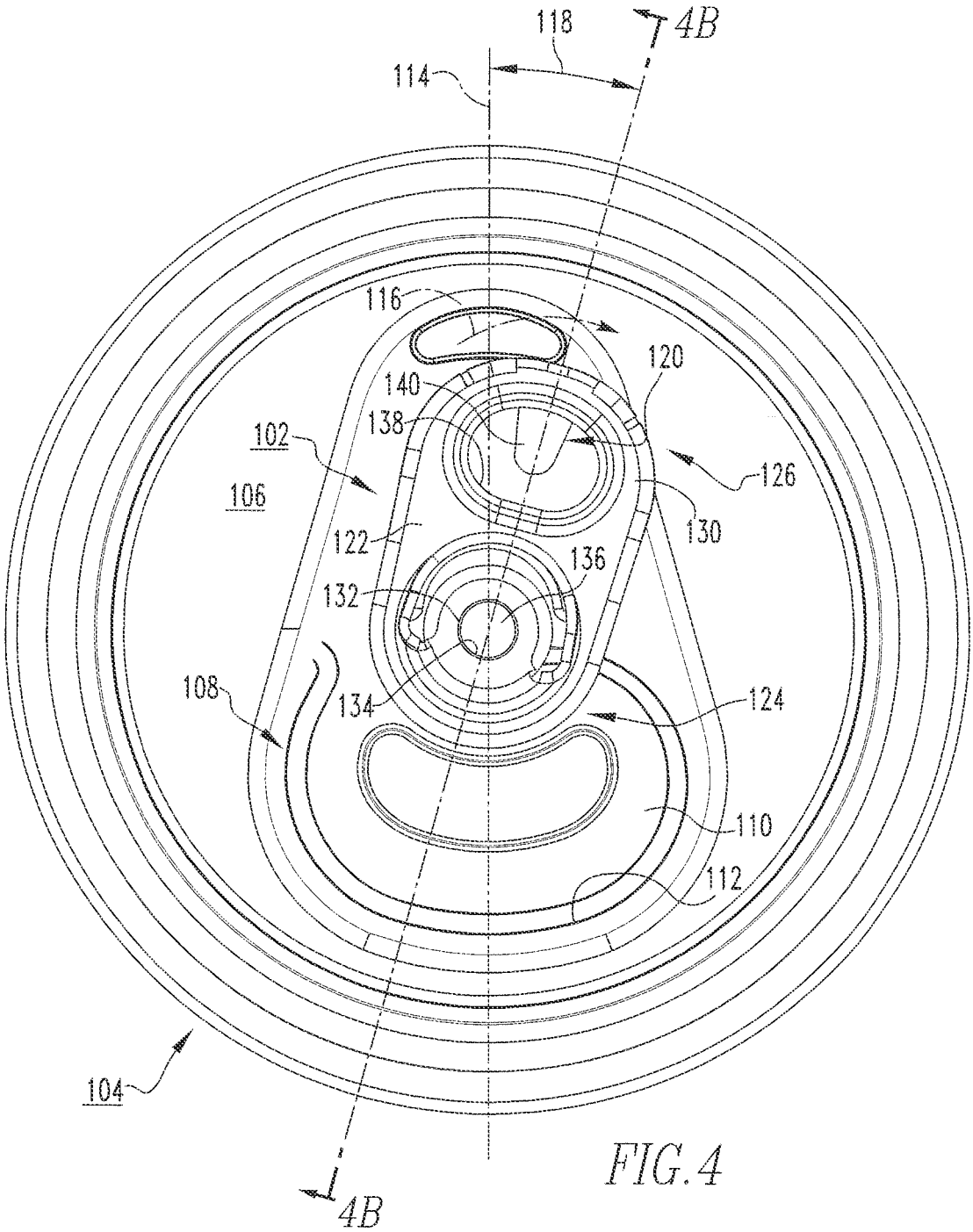
FIG. 4 is a top plan view of the can end and rotating tab therefor of FIG. 3, showing the tab in a rotated position.

FIGS. 3 and 4 show another no limiting alternative embodiment of a rotating tab 102 for a can end 104, in accordance with the disclosed concept. Like can end 4 discussed hereinabove with respect to FIGS. 1 and 2, the can end 104 includes an end panel 106 and a primary scoreline 108, which defines a tear panel 110 for providing a primary pour opening 112 (partially shown in FIGS. 4A and 4B), The tab 102 is shown in the standard position in FIG. 3, and in the rotated position in FIG. 4. That is, in FIG. 3, the tab 102 has not been rotated with respect to the longitudinal axis 114, shown. In FIG. 4, the tab 102 has been rotated (e.g., clockwise in the direction of arrow 116 from the perspective of FIG. 4) at an angle 118 with respect to the longitudinal axis 114, as shown. In one non-limiting example, the angle 118 is preferably between 5-50 degrees and, more preferably, is about 15 degrees.

Figure 4A:
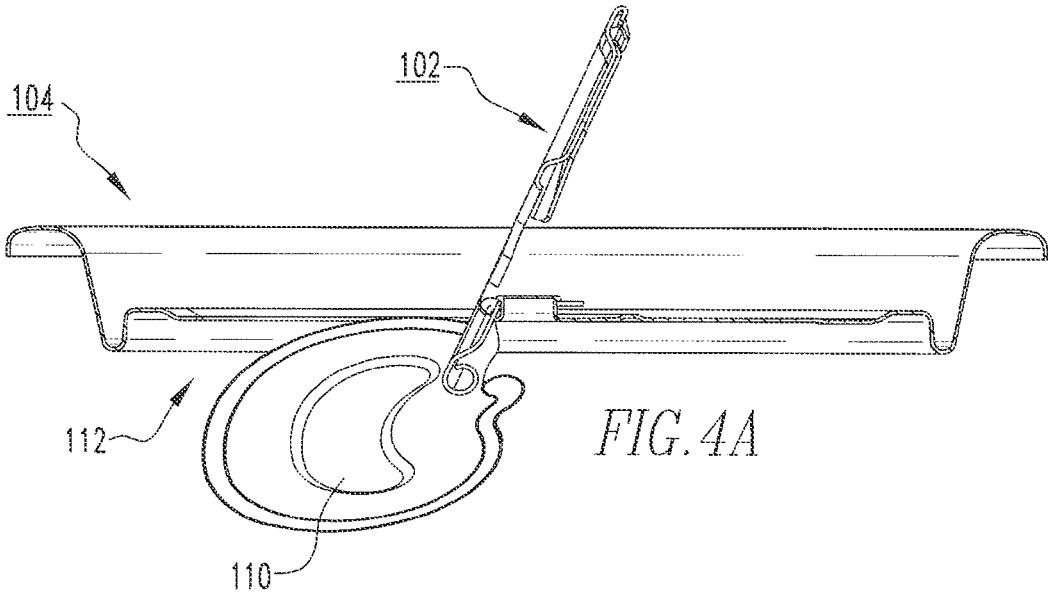
FIG. 4A is a section view taken along line 4A-4A of FIG. 3.
Figure 4B:
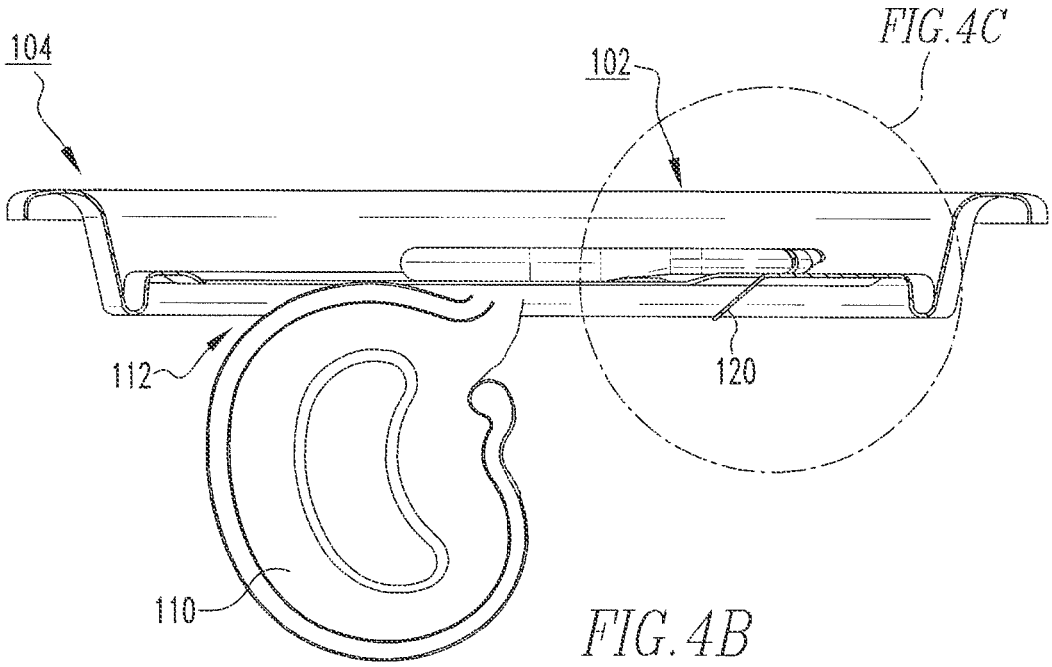
FIG. 4B is a section view taken along line 4B-4B of FIG. 4.
Figure 4C:
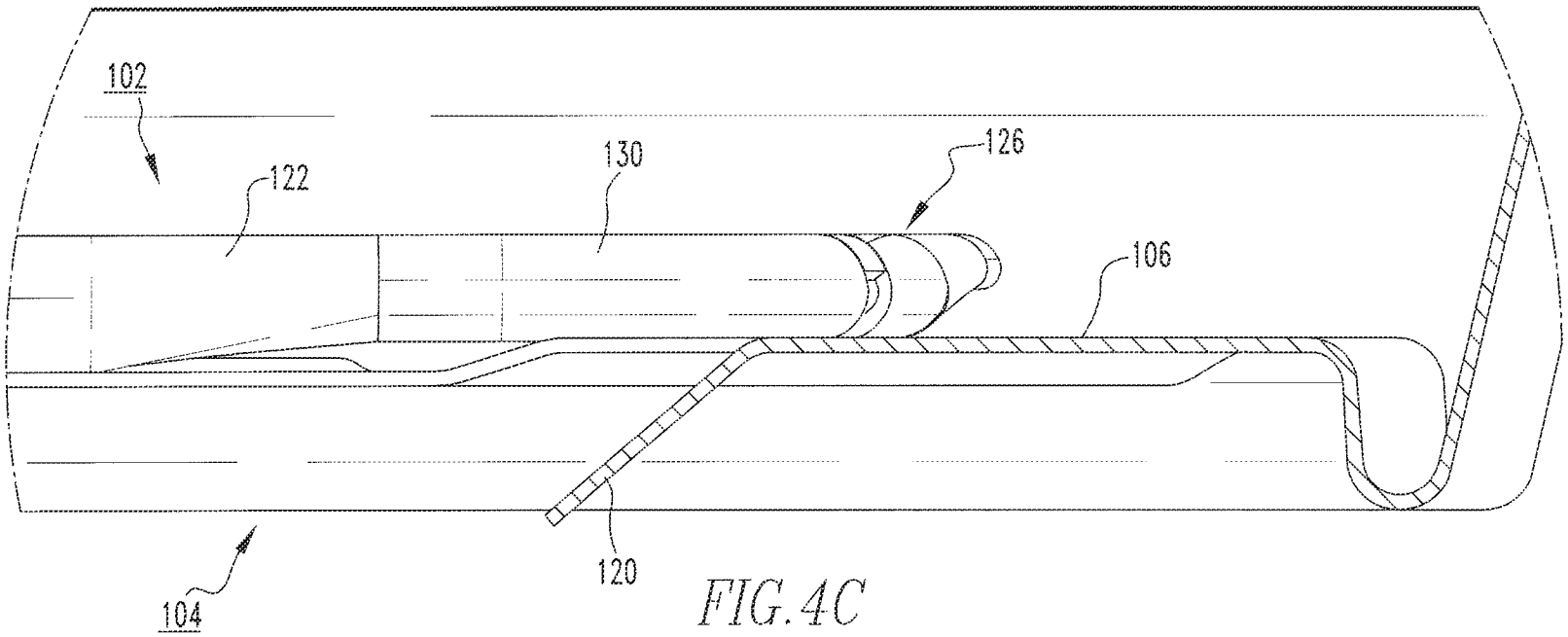
FIG. 4C is an enlarged view of section 4C of FIG. 4B.

Continuing to refer to FIGS. 3 and 4, the example can end 104 further includes a secondary scoreline 120, which is structured to be severed and depressed to vent the can end 104, as shown in FIGS. 4B and 4C. The example tab 102, includes a body 122 having opposing first and second ends 124,126. A nose portion 128 is located at or about the first end 124 of the tab 102, and a lift portion 130 is located at or about the second end 126 of the tab 102. A rivet receiving portion 132 is disposed proximate the nose portion 124, and includes a rivet hole 134. A rivet 136 extends outwardly from the end panel 106, through the rivet hole 134, and is staked to fasten the rivet receiving portion 132 of the tab 102 to the can end 104, as best shown in the section view of FIG. 4A.

Unlike the aforementioned tab 2, in the non-limiting example of FIGS. 3 and 4, the lift portion 130 of the tab 102 includes a finger hole 138. A depressible protrusion 140 extends into the finger hole 138, as shown. In other words, in operation, the protrusion 140 can be depressed such that the tab 102 itself advantageously functions to sever the secondary scoreline 120 and vent the can end 104, as shown in FIGS. 4B and 4C. Therefore, no separate tool or device (not shown) is required to vent the can end 104. FIG. 4A shows the can end 104 after the tab 102 has been actuated to sever the primary scoreline 108 and depress the tear panel 110 to create the primary pour opening 112, and FIGS. 4B and 4C show the can end 104 after the protrusion 140 has been depressed to sever and open the secondary scoreline or vent score 120 to vent the can end 104.

Figure 5:
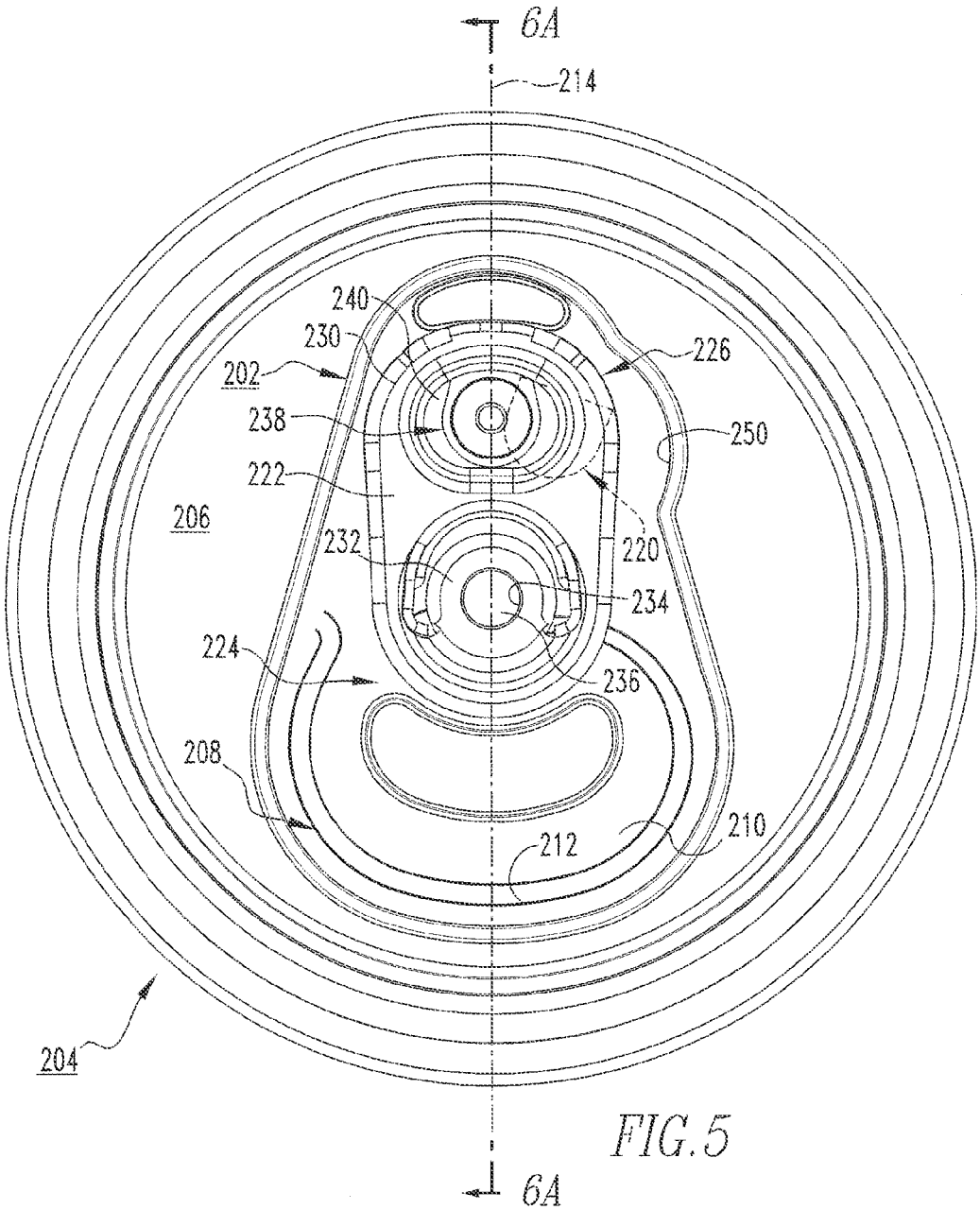
FIG. 5 is a top plan view of a can end and rotating tab therefor, in accordance with another embodiment of the disclosed concept, showing the tab in the standard position.
Figure 6:
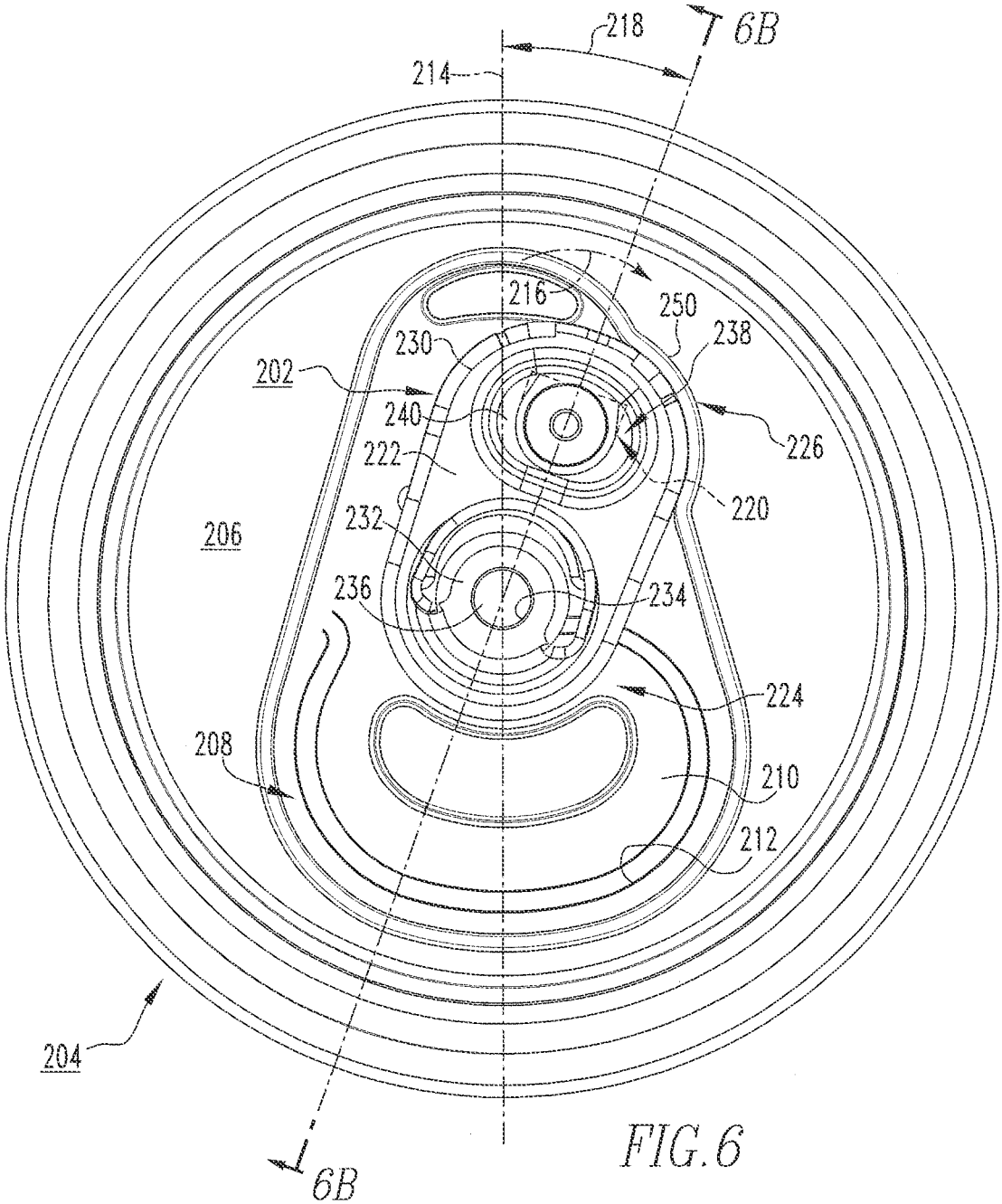

It will be appreciated, however, that any known or suitable alternative type, shape and/or location or configuration of secondary or vent scoreline (not shown) and/or corresponding protrusion(s) or other tab portion or feature (not shown) could be employed, without departing from the scope of the disclosed concept. It will further be appreciated that any known or suitable alternative type and/or configuration of tab (not shown) could be employed to vent the can end 104, in accordance with the disclosed concept. For example and without limitation, FIGS. 5 and 6 show another nonlimiting alternative embodiment of a rotating tab 202 for a can end 204, in accordance with the disclosed concept. Like can ends 4,104 discussed hereinabove with respect to FIGS. 1-4, the can end 204 includes an end panel 206 and a primary scoreline 208, which defines a tear panel 210 for providing a primary pour opening 212 (partially shown in FIGS. 6A and 6B).

The tab 202 is shown in the standard position in FIG. 5, and in the rotated position in FIG. 6. That is, in FIG. 5, the tab 202 has not been rotated with respect to the longitudinal axis 214, shown. In FIG. 6, the tab 202 has been rotated (e.g., clockwise in the direction of arrow 216 from the perspective of FIG. 6) at an angle 218 with respect to the longitudinal axis 214, as shown.

Figure 6A:
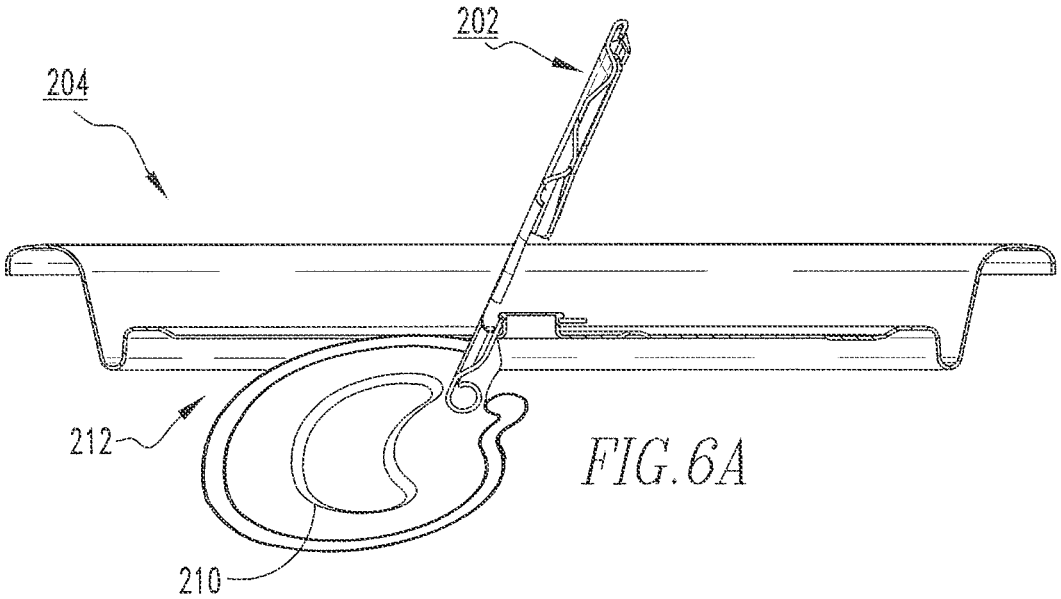
FIG. 6A is a section view taken along line 6A-6A of FIG. 5.
Figure 6B:
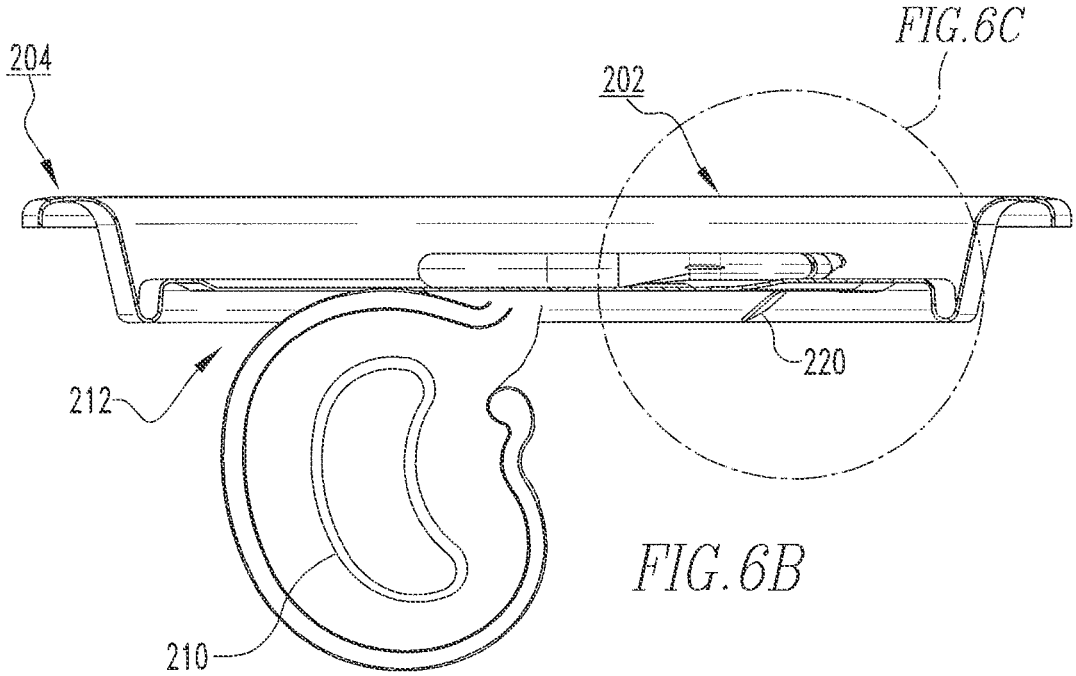
FIG. 6B is a section view taken along line 69-6B of FIG. 6.
Figure 6C:
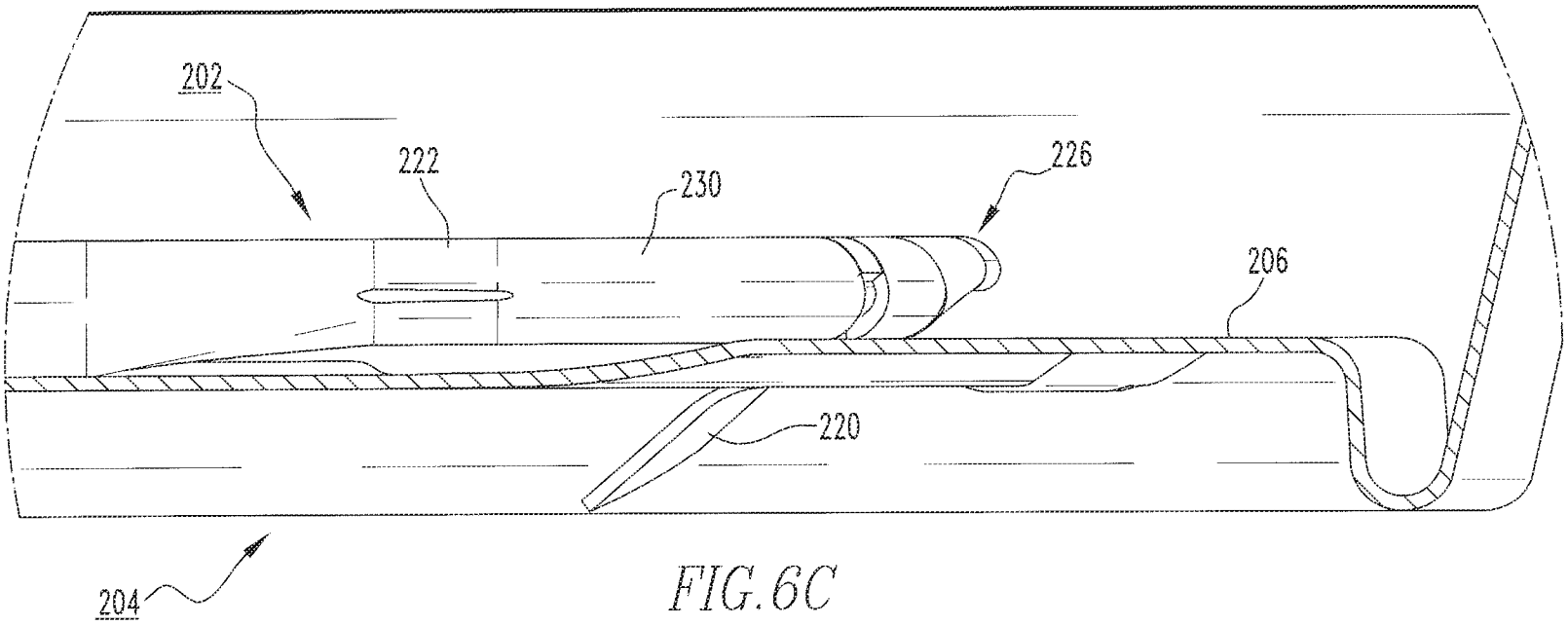
FIG. 6C is an enlarged view of section 6C of FIG. 6B.

Continuing to refer to FIGS. 5 and 6, the example can end 204 further includes a secondary scoreline 220, which is structured to be severed and depressed to vent the can end 204, as shown in FIGS. 6B and 6C. The example tab 202, includes a body 222 having opposing first and second ends 224,226. A nose portion 228 is located at or about the first end 224 of the tab 202, and a lift portion 230 is located at or about the second end 226. A rivet receiving portion 232 is disposed proximate the nose portion 224, and includes a rivet hole 234. A rivet 236 extends outwardly from the end panel 206, through the rivet hole 234, and is staked to fasten the rivet receiving portion 232 of the tab 202 to the can end 204, as best shown in the section view of FIG. 6A.

In the non-limiting example of FIGS. 5 and 6, the lift portion 230 of the tab 202 includes a button mechanism 238 extending into the finger hole area 240. That is, the button mechanism 238 is depressible so that, in operation, the tab 202 itself advantageously functions to sever the secondary scoreline 220 and vent the can end 204, as shown in FIGS. 6B and 6C. FIG. 6A shows the can end 204 after the tab 202 has been actuated to sever the primary scoreline 208 and depress the tear panel 210 to create the primary pour opening 212, and FIGS. 613 and 6C show the can end 204 after the button mechanism 238 has been depressed to sever and open the secondary scoreline or vent score 220 to vent the can end 204.

The end panel 206 in the example of FIGS. 5 and 6 has also been modified to include a pocket 250. The pocket 250 provides a feature for facilitating proper rotation of the tab 202 to align the button mechanism 238 with the secondary scoreline or vent score 220 (see, for example, FIG. 6). That is, the pocket 250 preferably has a shape or profile substantially similar to the arcuate profile of the edge of the lift portion 230 of the tab 202. Thus, when the tab 202 is rotated (e.g., clockwise in the direction of arrow 216 from the perspective of FIG. 6), rotation is stopped when the edge of the lift portion 230 is aligned with the pocket 250, as shown in FIG. 6. In this configuration, the secondary scoreline 220 is disposed beneath the button mechanism 238 and is ready to be severed upon depressing the button mechanism 238 (e.g., downardly from the perspective of FIG. 6), In the non-limiting example of FIG. 6, the angle 218 at which the tab 202 is rotated with respect to the axis 214 associated with the standard position of the tab 202 (FIG. 5) is preferably between 10-60 degrees, and more preferably, is about 20 degrees.

It will be appreciated, however, that any known or suitable alternative type, shape and/or location or configuration of secondary scoreline or vent score (not shown) and/or corresponding tab feature (not shown) could be employed, without departing from the scope of the disclosed concept. It will further be appreciated that any known or suitable alternative type and/or configuration of tab (not shown), and/or any known or suitable portion or feature e.g., without limitation, underside; edge; projection; extension; segment; member) of the tab 202, could be employed to depress and sever the secondary scoreline or vent score 220 to vent the can end 204, in accordance with the disclosed concept.

Figure 7:
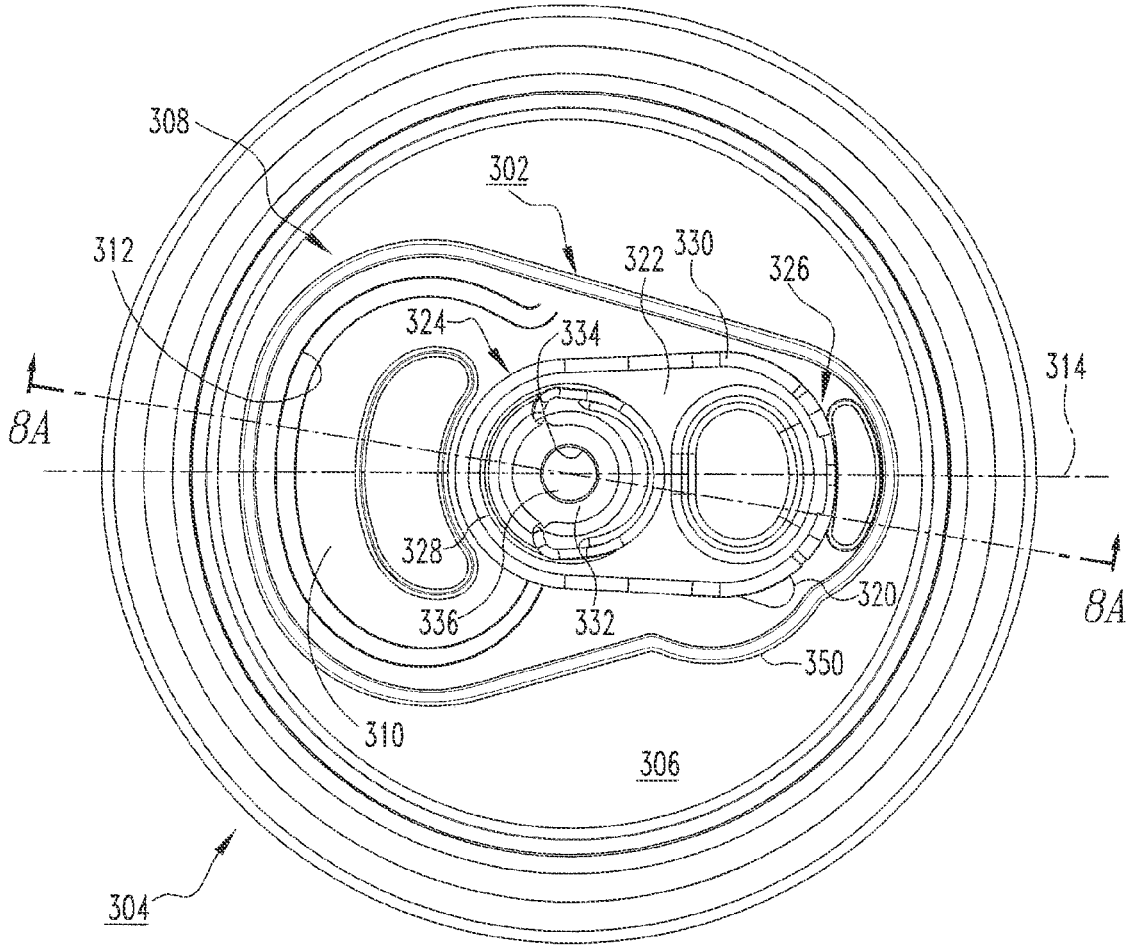
FIG. 7 is a top plan view of a can end and rotating tab therefor, in accordance with another embodiment of the disclosed concept, showing the tab in the standard position.
Figure 8:
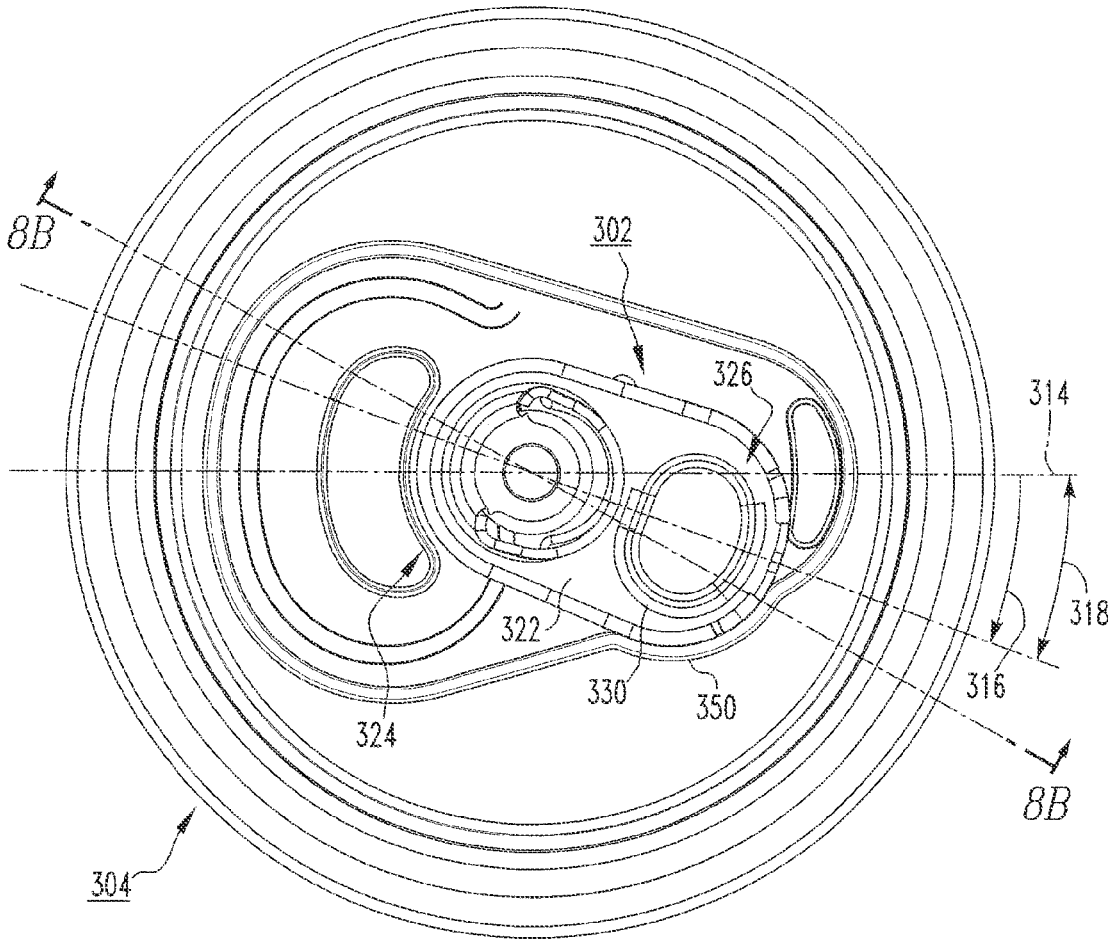
FIG. 8 is a top plan view of the can end and rotating tab therefor of FIG. 7, showing the tab in a rotated position.
Figure 8A:
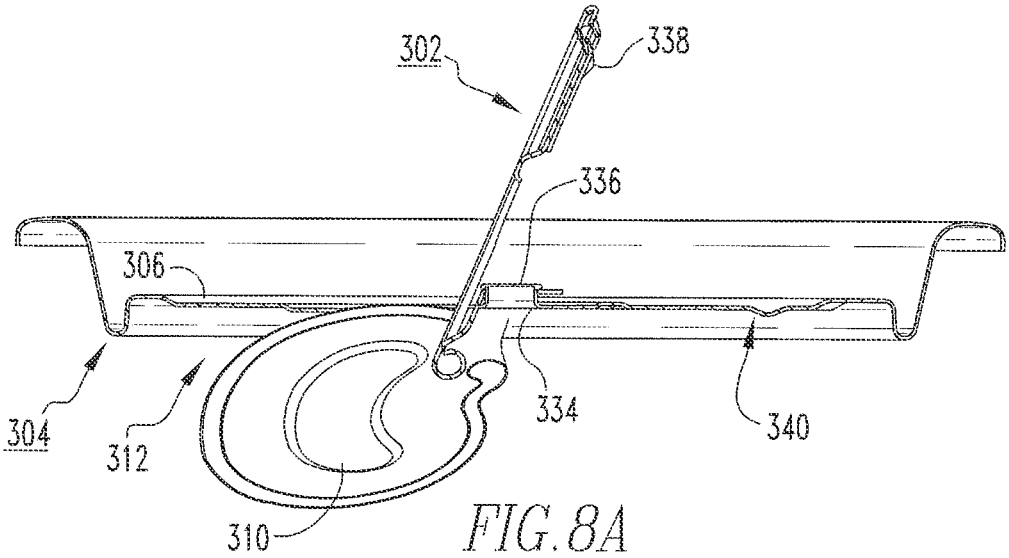
FIG. 8A is a section view taken along line 8A-8A of FIG. 7.
Figure 8B:
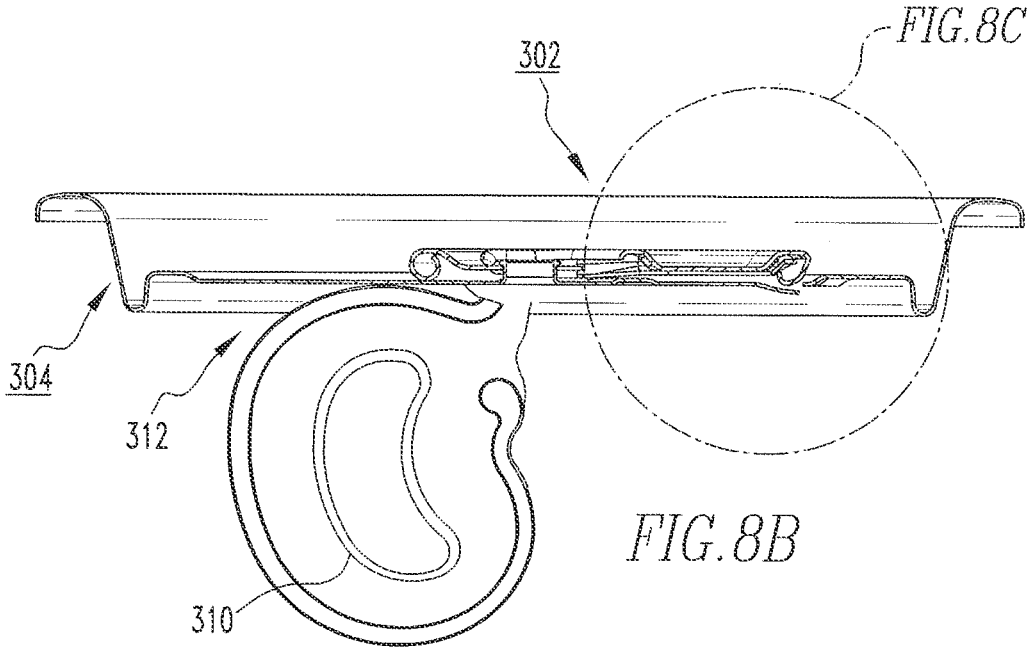
FIG. 8B is a section view taken along line 8B-8B of FIG. 8.
Figure 9:
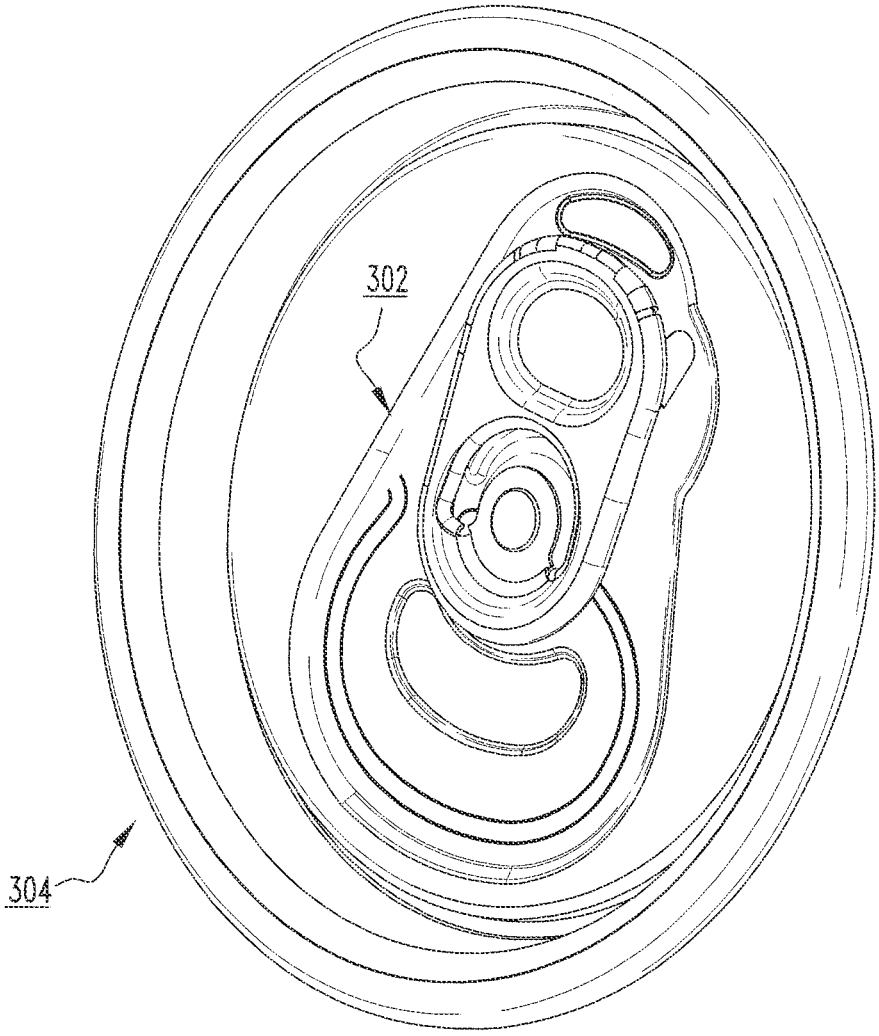
FIG. 9 is an isometric view of the can end and rotating tab therefor of FIG. 7.

FIGS. 7-9 show another non-limiting alternative embodiment of a rotating tab 302 for a can end 304. The can end 304 includes an end panel 306 and a primary scoreline 308, which defines a tear panel 310 for providing a primary pour opening 312 (FIGS. 8A and 8B).

The tab 302 is shown in the standard position in FIGS. 7 and 9, and in the rotated position in FIG. 8. That is, in FIG. 7, the tab 302 has not been rotated with respect to the longitudinal axis 314, shown. In FIG. 8, the tab 302 has been rotated (e.g., clockwise in the direction of arrow 316 from the perspective of FIG. 8) at an angle 318 with respect to the longitudinal axis 314, as shown. In one non-limiting example, the angle 318 is preferably between 10-60 degrees and, more preferably, is about 20 degrees.

Figure 8C:
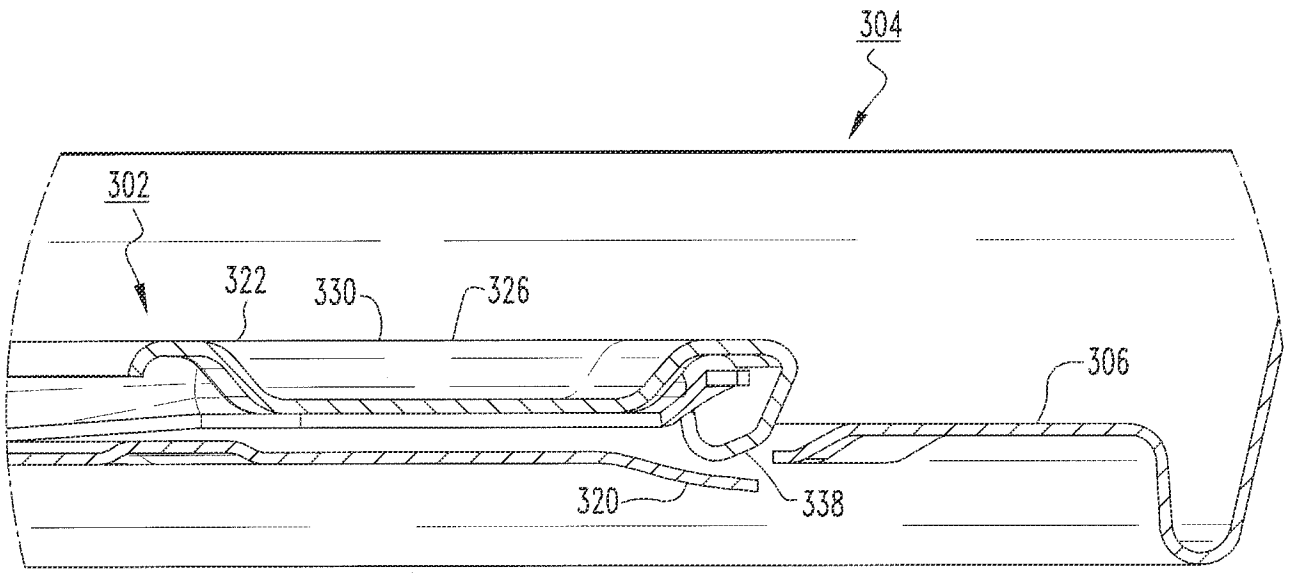
FIG. 8C is an enlarged view of section 8C of FIG. 8B.

Continuing to refer to FIGS. 7 and 8, the example can end 304 further includes a secondary scoreline 320, which is structured to be severed and depressed to vent the can end 304, as shown in FIGS. 8B and 8C. The example tab 302, includes a body 322 having opposing first and second ends 324,326. A nose portion 328 is located at or about the first end 324 of the tab 302, and a lift portion 330 is located at or about the second end 326. A rivet receiving portion 332 is disposed proximate the nose portion 224, and includes a rivet hole 334. A rivet 336 extends outwardly from the end panel 306, through the rivet hole 334, and is staked to fasten the rivet receiving portion 332 of the tab 302 to the can end 304, as best shown in the section view of FIG. 8A.

In the non-limiting embodiment of FIGS. 7 and 8, the lift portion 330 of the tab 302 includes a protrusion 338 (FIG. 8C), which preferably extends downwardly (from the perspective of FIG. 8C) from the curl portion at or about the lift portion 330 of the second end 326 of the tab 302, toward the end panel 306. When the tab 302 is in the standard position of FIG. 7 and has not yet been actuated (e.g., without limitation, to sever the scoreline 308 and open the tear panel 310 as shown in FIG. 8A), the protrusion 338 (FIG. 8C) is structured to be disposed in a corresponding downwardly extending recess or cavity 340 (FIG. 8A) in the end panel 306.

In operation, after tab 302 has been actuated to open the tear panel 310 with the nose portion 328 at the first end 324 of the tab 302, as shown in FIG. 8A, the tab 302 can be rotated to the position shown in FIG. 8 to align the protrusion 238 with the secondary scoreline 320 (FIGS. 7 and 8C) in the end panel 306. The tab 302 and, in particular the protrusion 338 extending downwardly from the lift portion 330, can then be depressed to sever the secondary scoreline 320 and vent the can end 304, as shown in FIGS. 8B and 8C.

The end panel 306 in the example of FIGS. 7 and 8 also includes a pocket 350. Like the aforementioned pocket 250 described hereinabove with respect to FIGS. 5 and 6, the pocket 350 provides a feature for facilitating proper rotation of the tab 302 to align the tab protrusion 338 with the secondary scoreline or vent score 320 (see, for example, FIG. 8). That is, the pocket 350 preferably has a shape or profile substantially similar to the arcuate profile of the edge of the lift portion 330 of the tab 302. Thus, when the tab 302 is rotated (e.g., clockwise in the direction of arrow 316 from the perspective of FIG. 8), rotation is stopped when the edge of the lift portion 330 is aligned with the pocket 350, as shown in FIG. 8. In this configuration, the secondary scoreline 320 is disposed beneath the tab protrusion 338 and is ready to be severed upon depressing the tab and, in particular, the protrusion 338 (e.g., downardly from the perspective of FIGS. 8, 8B and 8C).

It will be appreciated, however, that any known or suitable alternative type, shape and/or location or configuration of secondary scoreline or vent score (not shown) and/or corresponding tab feature (not shown) could be employed, without departing from the scope of the disclosed concept. It will further be appreciated that any known or suitable alternative type and/or configuration of tab (not shown), and/or any known or suitable portion or feature (e.g., without limitation, underside; edge; projection; extension; segment; member) of the tab 302, could be employed to depress and sever the secondary scoreline or vent score 320 to vent the can end 304, in accordance with the disclosed concept.

Among other benefits, the disclosed rotating tab (e.g., without limitation, rotating tabs 2,102,202,302) preferably comprises a single unitary piece of material as opposed to requiring a plurality of relatively complex components or pieces. The tab 2,102,202,302 also functions in a unique and relatively simple manner to effectively vent the can end 4,104,204,304 using an existing feature of the container.

A tooling assembly (not shown) for providing the rotating tab (e.g., without limitation, rotating tab 2,102,202,302) and can end (e.g., without limitation, can end 4,104,204,304) generally includes a number of tooling stations each including a first tool member and a second tool member disposed opposite the first tool member. The first and second tool members are structured to cooperate in order to form the tab having the aforementioned features. It will also be appreciated that a number of tooling stations and tool members therefor are employed within a conversion press to convert shells into finished can ends (e.g., without limitation, can end 4,104,204,304) having the aforementioned secondary scoreline (e.g., without limitation, secondary scoreline or vent score 20,120,220,320) and other features, and the disclosed rotating tab affixed thereto, and being ready to be affixed (e.g., without limitation, seamed) to corresponding containers (e.g., without limitation, can bodies).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A can end comprising:

an end panel including a pocket having a profile;

a rivet extending outwardly from the end panel;

a primary scoreline defining a tear panel in the end panel for providing a primary pour opening in the can end;

a secondary scoreline in the end panel; and a tab comprising:

a body including a first end and a second end disposed opposite and distal from the first end, a nose portion located at or about the first end of the tab, a lift portion located at or about the second end of the tab, said lift portion including an edge having a profile corresponding to the profile of the pocket of said end panel, and a rivet receiving portion disposed proximate the nose portion, the rivet receiving portion including a rivet hole, the rivet extending through said rivet hole and being staked to fasten the rivet receiving portion of the tab to the can end, wherein the body of the tab is structured to be rotated about the rivet until the profile of the edge of said lift portion is aligned with the corresponding profile of said pocket to align a portion of the tab with the secondary scoreline, and wherein, when the profile of the edge of said lift portion is aligned with the corresponding profile of said pocket, said portion of the tab is structured to be depressed to sever the secondary scoreline to vent the can end.

2. The can end of claim 1 wherein a longitudinal axis extends through the center of the tear panel of the can end; wherein the tab rotates between a standard position and a rotated position; and wherein, when the tab is disposed in the rotated position, the body of the tab is disposed at an angle with respect to the longitudinal axis.

3. The can end of claim 2 wherein the angle is between 5 degrees and 60 degrees.

4. The tab of claim 1 wherein the body further includes a recessed panel disposed at or about the lift portion.

5. The can end of claim 1 wherein the lift portion has an arcuate edge profile; and wherein the secondary scoreline has a profile substantially similar to the arcuate edge profile of the lift portion.

6. The can end of claim 1 wherein the lift portion includes a finger hole and a protrusion extending into the finger hole.

7. The can end of claim 1 wherein the lift portion includes a button mechanism.

8. The can end of claim 1 wherein the lift portion includes a protrusion; and wherein the protrusion is structured to extend outwardly from the tab toward the end panel.

9. The can end of claim 1 wherein the can end is selected from the group consisting of beer can ends, beverage can ends and food can ends.

10. The can of claim 1 wherein the tab is made from a single unitary piece of material.

* * * * *

UNITED STATES PATENT AND TRADEMARK OFFICE

CERTIFICATE OF CORRECTION

PATENT NO. : 9,102,451 B2
APPLICATION NO. : 14/519575
DATED : August 11, 2015
INVENTOR(S) : James A. McClung et al.

It is certified that error appears in the above-identified patent and that said Letters Patent is hereby corrected as shown below:

In the Specification

Column 1, line 42, “Titus” should read --Thus--.
Column 2, line 21, “ear” should read --tear--.
Column 2, line 63, “2B-29” should read --2B-2B--.
Column 3, lines 11 and 12, “therefor of
FIG. 5, showing the tab in a rotated position;” should read
--therefor of FIG. 5, showing the tab in a rotated position;--.
Column 3, line 16, “69-6B” should read --6B-6B--.
Column 3, line 37, “contains” should read --containers--.
Column 4, lines 37 and 38, “can end 4.
The example tab 2,” should read
--the can end 4. The example tab 2,--.
Column 4, line 59, “29” should read --2B--.
Column 4, lines 61 and 62, “end 4.
Therefore, unlike” should read
--end 4. Therefore, unlike--.
Column 5, line 66, “no limiting” should read --non-limiting--.
Column 6, line 51, “nonlimiting” should read --non-limiting--.
Column 7, line 22, “613” should read --6B--.
Column 8, line 11, “224” should read --328--.

Signed and Sealed this
Twelfth Day of April, 2016

Michelle K. Lee

Michelle K. Lee
*Director of the United States Patent and Trademark Office*